US005810639A

United States Patent [19]

Liu

[11] Patent Number: 5,810,639

[45] Date of Patent: Sep. 22, 1998

[54] CONSTRUCTION TOY BLOCK AND CONNECTOR SET

[76] Inventor: Jin-Su Liu, P.O. Box 372, Hsin-Chu, Taiwan

[21] Appl. No.: 736,007

[22] Filed: Oct. 23, 1996

[51] Int. Cl.[6] ..... A63H 33/12; A63H 33/00; A63H 33/08

[52] U.S. Cl. ..... 446/111; 446/102; 446/104; 446/115; 446/128

[58] Field of Search ..... 446/102, 104, 446/106, 108, 109, 110, 111, 112, 113, 115, 117, 120, 122, 123, 125, 127, 128, 116

[56] References Cited

U.S. PATENT DOCUMENTS

| | | | |
|---|---|---|---|
| 1,245,440 | 11/1917 | Converse | 446/127 |
| 4,704,313 | 11/1987 | Maier | 446/116 X |
| 4,712,336 | 12/1987 | Backer | 446/122 X |
| 4,833,856 | 5/1989 | Zwagerman | 446/122 X |
| 4,874,341 | 10/1989 | Ziegler | 446/104 X |

FOREIGN PATENT DOCUMENTS

| | | | |
|---|---|---|---|
| 101572 | 4/1965 | Denmark | 446/111 |
| 1168305 | 5/1960 | Germany | 446/102 |
| 2423417 | 5/1975 | Germany | 446/102 |
| 2423446 | 5/1975 | Germany | 446/102 |
| 605437 | 5/1960 | Italy | 446/111 |
| 2031289 | 4/1980 | United Kingdom | 446/111 |
| 2054393 | 2/1981 | United Kingdom | 446/108 |

*Primary Examiner*—Robert A. Hafer
*Assistant Examiner*—D. Neal Muir
*Attorney, Agent, or Firm*—Rosenberg, Klein & Bilker

[57] ABSTRACT

A construction toy block set including a plurality of toy block elements respectively made of flat shape, a plurality of swivel connectors, and a plurality of fixed connectors, the block elements having pins and coupling recesses for coupling to one another directly, and retaining slots for coupling to one another by the swivel connectors or the fixed connectors, the swivel connectors being adapted for connecting the block elements together, permitting them to be turned relative to one another, the fixed connectors being adapted for connecting the block elements together and preventing them from being turned relative to one another.

12 Claims, 13 Drawing Sheets

CONSTRUCTION TOY BLOCK AND CONNECTOR SET

BACKGROUND OF THE INVENTION

The present invention relates to construction toys, and relates more particularly to such a construction toy comprised of a plurality of planar block elements, a plurality of swivel connectors, and a plurality of fixed connectors for connection with one another into any of a variety of three-dimensional patterns.

U.S. Pat. No. 5,545,070, issued to the present inventor, discloses a construction toy set of planar blocks with apertures and hinged connectors. This construction toy, as shown in FIGS. from 14 to 17, comprises a plurality of block elements 100, and a plurality of swivel connectors 200. The block element 100, as shown in FIGS. 14 and 15, is made of flat, square shape having a center pin 1110 and four corner pins 110 at the top side, a center pin hole 1210 and four corner pin holes 120 at the bottom side, four elongated first retaining slots 140 equiangularly spaced around the center of the block element and respectively disposed in parallel with the four peripheral sides, and four second retaining slots 130 respectively and perpendicularly extended from the first retaining slots 140 to the border. The swivel connector 200, as shown in FIGS. 16 and 17, comprises two reversed base elements 210 and an axle 220. The base element 210 fits the second retaining slot 130 in width, having an axle housing 230 at one end, a retainer plate 2130 at an opposite end, which fits the first retaining slot 140, a pin 2110 at one side, and a pin hole 2120 at an opposite side. The size of the pin 2110 is equal to that of the pins 110 and 1110. The size of the pin hole 2120 is equal to that of the pin holes 120 and 1210. The axle 220 is inserted into the axle housings 230 of the two reversed base elements 210, permitting the reversed base elements 210 to be respectively turned about the axle 220. This structure of construction toy provides many variations. However, if a pressure is evenly applied to the two reversed base elements 210 in reversed directions, the reversed base elements 210 will be forced to damage the axle 220. Further, when the block elements 100 and the swivel connectors 200 are constructed into a big plane, it is difficult to keep the surface in flush because of the ratatable nature of the swivel connectors 200.

SUMMARY OF THE INVENTION

The present invention improves the aforesaid drawbacks. According to one aspect of the present invention, the construction toy block set comprises a plurality of toy block elements respectively made of flat shape, a plurality of swivel connectors, and a plurality of fixed connectors, the block elements having pins and coupling recesses for coupling to one another directly, and retaining slots for coupling to one another by the swivel connectors or the fixed connectors, the swivel connectors being adapted for connecting the block elements together, permitting them to be turned relative to one another, the fixed connectors being adapted for connecting the block elements together and preventing them from being turned relative to one another. According to another aspect of the present invention, each of the swivel connectors comprises a base element, an auxiliary element, and an axle, the base element comprising a barrel, a projecting block perpendicularly raised from the periphery of the barrel in the middle, a pin perpendicularly raised from the projecting block at one side of which the size is equal to that of the pins of the block elements, a recessed hole formed in the projecting block at an opposite side, a coupling block connected to the projecting block at one end remote from and in parallel to said barrel, and a transverse slot across the barrel in the middle corresponding to the projecting block, the coupling block of the base element fitting the first retaining slots of the block elements, the auxiliary element comprising a substantially rectangular base, a pin perpendicularly raised from one lateral side of the base of which the size is equal to that of the pins of the block elements, a recessed hole formed in an opposite lateral side of the base, a coupling eye plate longitudinally raised from a front side of the base and adapted for fitting into the transverse opening of the base element, and a coupling block perpendicularly connected to a rear side of the base, the coupling block of the auxiliary element fitting the first retaining slots of the block elements, the axle being inserted into the barrel of the base element and the coupling eye plate of the auxiliary element to connect them together, permitting them to be respectively turned thereabout.

DETAILED DESCRIPTION OF THE PREFERRED EMBODIMENT

Figure 1:
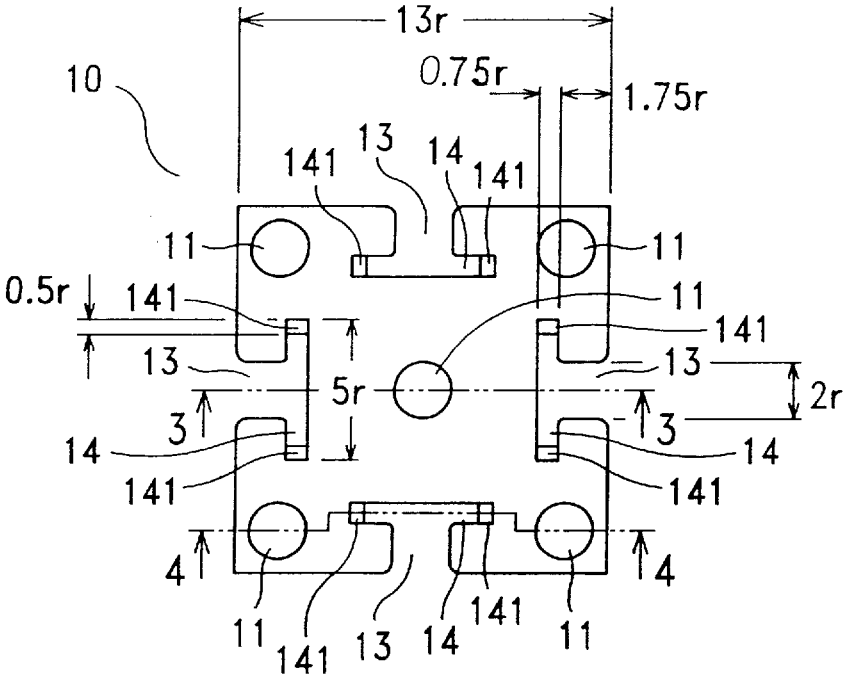
FIG. 1 shows the top side structure of a square block element according to the present invention.
Figure 2:
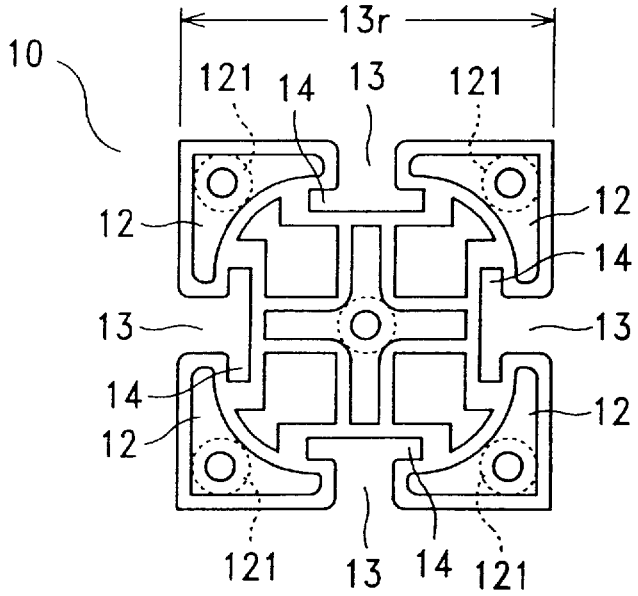
FIG. 2 shows the bottom side structure of the square block element shown in FIG. 1.

Referring to FIGS. 1 and 2, the block element, referenced by 10, is made of flat, square shape having a plurality of pins 11 raised from the top side at the center and the four corners, a plurality of coupling recesses 12 at the bottom side corresponding to the pins 11, four elongated first retaining slots 14 equiangularly spaced around the center of the block element and respectively disposed in parallel with the four peripheral sides, and four second retaining slots 13 respectively and perpendicularly extended from the first retaining slots 14 to the border. Each first retaining slot 14 has two steps 141 symmetrically disposed near the two opposite ends (see also FIG. 4).

Figure 3:
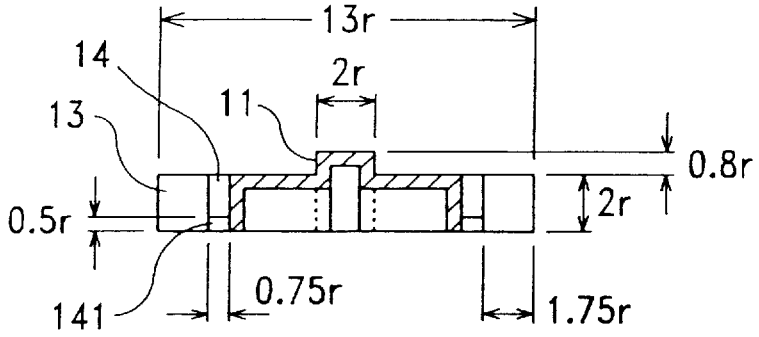
FIG. 3 is a sectional view taken along line 3—3 of FIG. 1.
Figure 4:
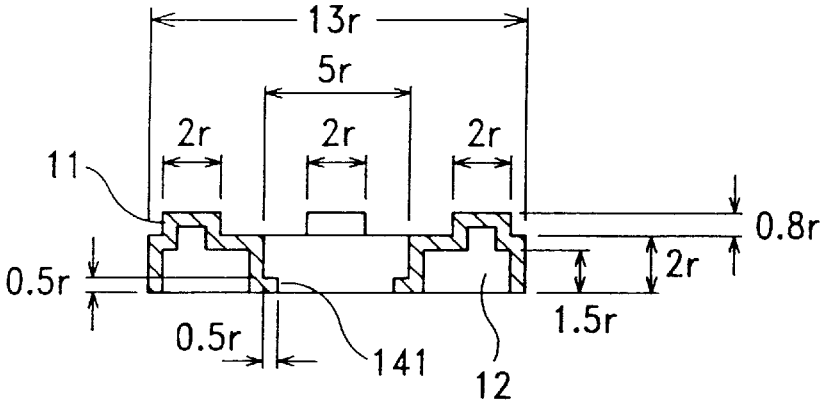
FIG. 4 is a sectional view taken along line 4—4 of FIG. 1.

Referring to FIGS. 3 and 4, when a unit length "r" is used for measuring the size of the square block element 10, the length of each peripheral side is 13r, the thickness is 2r, the diameter of the pins 11 is 2r, the height of the pins 11 is 0.8r, the coupling recess 12 defines an inscribed circle 121 of diameter 2r and depth 1.5r, the width of the second retaining slots 13 is 2r, the depth of the second retaining slots 13 is 1.75r, the depth of the first retaining slots 14 is 0.5r, the width of the first retaining slots 14 is 5r, the width of the step 141 is 0.5r, the height of the step 141 is o.5r. Therefore, the pins 11 of one block element 10 can be fitted into the coupling recesses 13 of another, the thickness of one block element 10 can be fitted into one second retaining slot 13 of another.

Figure 5:
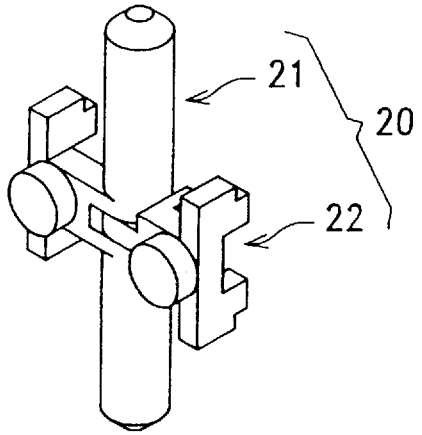
FIG. 5 is an elevational view of a swivel connector according to the present invention.
Figure 6:
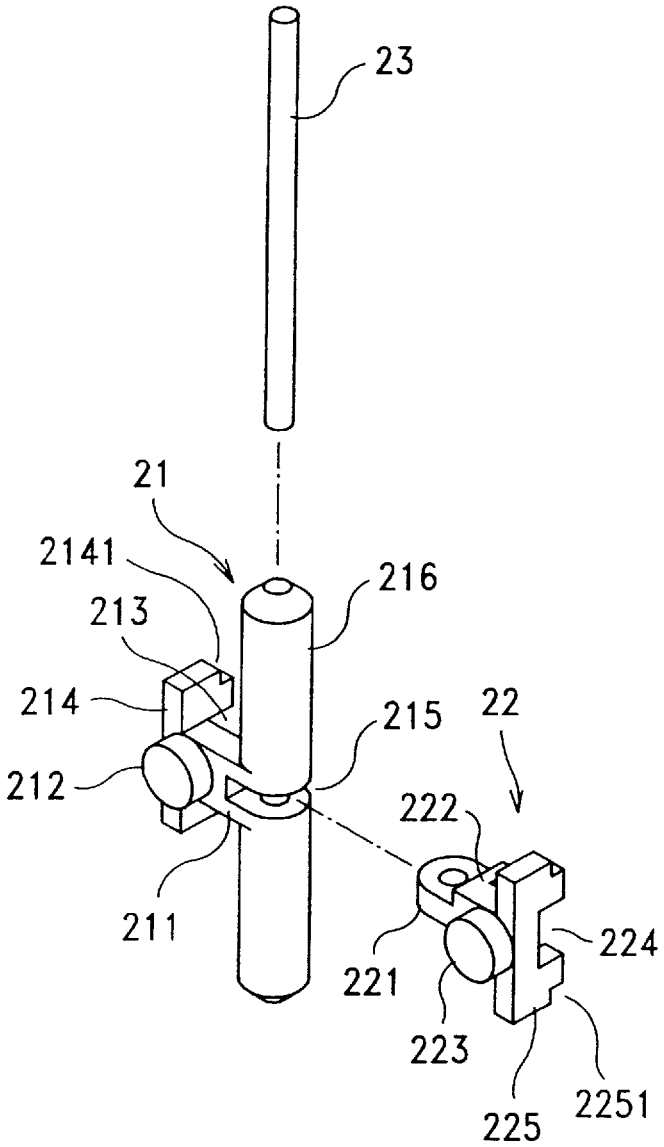
FIG. 6 is an exploded view of the swivel connector shown in FIG. 5.
Figure 7D:
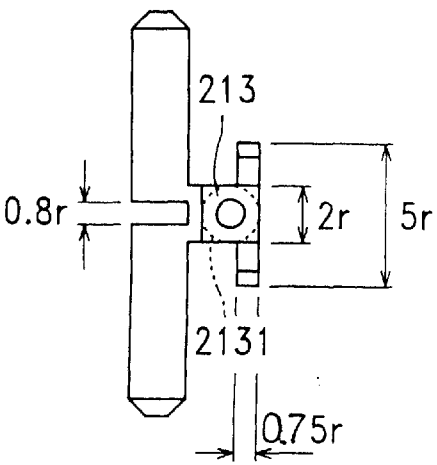
FIG. 7D is a back side view of the base element of the swivel connector shown in FIG. 5.
Figure 7C:
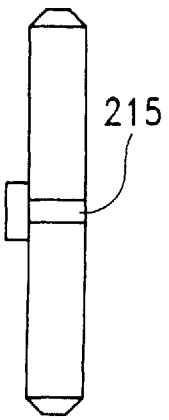
FIG. 7C is a right side view of the base element of the swivel connector shown in FIG. 5.
Figure 7A:
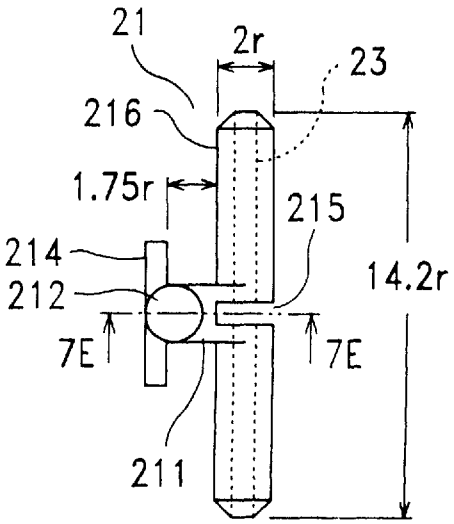
FIG. 7A is a front plain view of the base element of the swivel connector shown in FIG. 5.
Figure 7E:
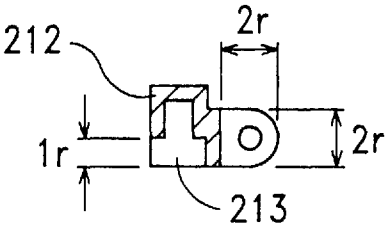
FIG. 7E is a sectional view taken along line 7E—7E of FIG. 7A.
Figure 7B:
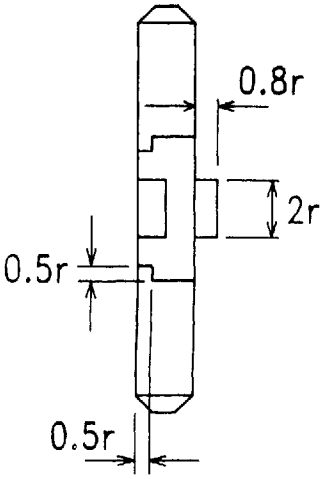
FIG. 7B is a left side view of the base element of the swivel connector shown in FIG. 5.
Figure 8D:
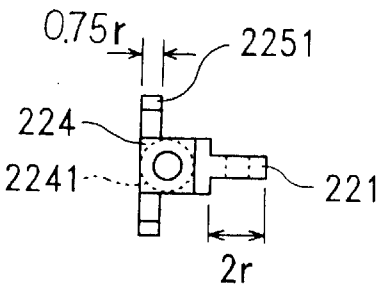
FIG. 8D is a back side view of the auxiliary element of the swivel connector shown in FIG. 5.
Figure 8C:
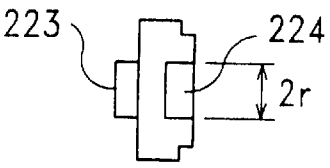
FIG. 8C is a right side view of the auxiliary element of the swivel connector shown in FIG. 5.
Figure 8A:
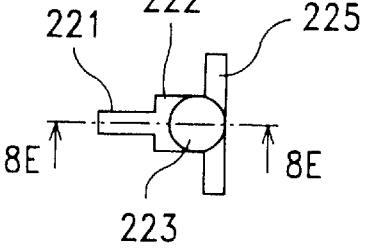
FIG. 8A is a front view of the auxiliary element of the swivel connector shown in FIG. 5.
Figure 8B:
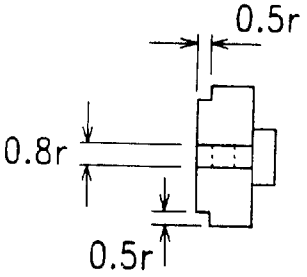
FIG. 8B is a left side view of the auxiliary element of the swivel connector shown in FIG. 5.
Figure 8E:
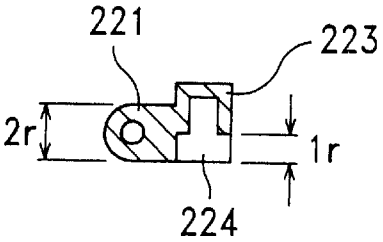
FIG. 8E is a sectional view taken along line 8E—8E of FIG. 8A.

Referring to FIGS. 5 and 6, the swivel connector, referenced by 20, comprises a base element 21, an auxiliary element 22, and an axle 23. The base element 21 comprises a barrel 216, a projecting block 211 perpendicularly raised from the periphery of the barrel 216 in the middle, a pin 212 perpendicularly raised from the projecting block 211 at one side of which the size is equal to that of the pins 11 of the aforesaid block elements 10, a recessed hole 213 formed in the projecting block 211 at an opposite side, a coupling block 214 connected to the projecting block 211 at one end remote from and in parallel to the barrel 216, and a transverse slot 215 across the barrel 216 in the middle corresponding to the projecting block 211. The coupling block 214 fits the first retaining slots 14 of the aforesaid block elements 10, having two notches 2141 fitting the steps 141 of one first retaining slot 14. The auxiliary element 22 comprises a substantially rectangular base 222, a pin 223 perpendicularly raised from one lateral side of the base 222 of which the size is equal to that of the pins 11 of the aforesaid block elements 10, a recessed hole 224 formed in an opposite lateral side of the base 211, a coupling eye plate 221 longitudinally raised from the front side of the base 222 and adapted for fitting into the transverse opening 215 of the base element 21, and a coupling block 225 perpendicularly connected to the rear side of the base 222. The coupling block 225 fits the first retaining slots 14 of the aforesaid block elements 10, having two notches 2251 fitting the steps 141 of one first retaining slot 14. The axle 23 is inserted into the barrel 216 of the base element 21 and the coupling eye plate 221 of the auxiliary element 22 to connect the base element 21 and the auxiliary element 22 together, permitting them to be respectively turned about the axle 23.

Referring to FIGS. from 7A to 7E, when the aforesaid unit length "r" is used for measuring the size of the base element 21 of the swivel connector 20, the diameter of the barrel 216 is 2r, the length of the barrel 216 is 14.2r, the length of the projecting block 211 is 1.75r, the width of the projecting block 211 2r, the thickness of the projecting block 211 is 2r, the diameter of the pin 212 is 2r, the height of the pin 212 is 0.8r, the recessed hole 213 defines an inscribed circle of diameter 2r and depth 1r, the length of the coupling block 214 is 5r, the width of the coupling block 214 is 0.5r, the thickness of the coupling block 214 is 2r, the longitudinal length of the notch 2141 is 0.5r, the transverse length of the notch 2141 is 0.5r, the transverse length of the transverse opening 215 is 2r, the longitudinal height of the transverse opening 215 is 0.8r.

Referring to FIGS. from 8A to 8E, when the aforesaid unit length "r" is used for measuring the size of the auxiliary element 22 of the swivel connector 20, the length of the coupling eye plate 221 is 2r, the length of the base 222 is 1.75r, the width of the base 222 is 2r, the thickness of the base 222 is 2r, the diameter of the pin 223 is 2r, the height of the pin 223 is 1r, the recessed hole 224 has a rectangular shape defining an inscribed circle of diameter 2r and depth 1r, the length of the coupling block 225 is 5r, the width of the coupling block 225 is 0.5r, the thickness of the coupling block 225 is 2r, the longitudinal length of the notch 2251 is 0.5r, the transverse length of the notch 2251 is 0.5r.

According to the aforesaid specifications, the pin 11 can be fitted into the recessed hole 213 or 224; the coupling recess 12 can be engaged with the pin 212 or 223 firmly; the first retaining hole 14 can be engaged with the coupling block 214 or 225.

Figure 9:
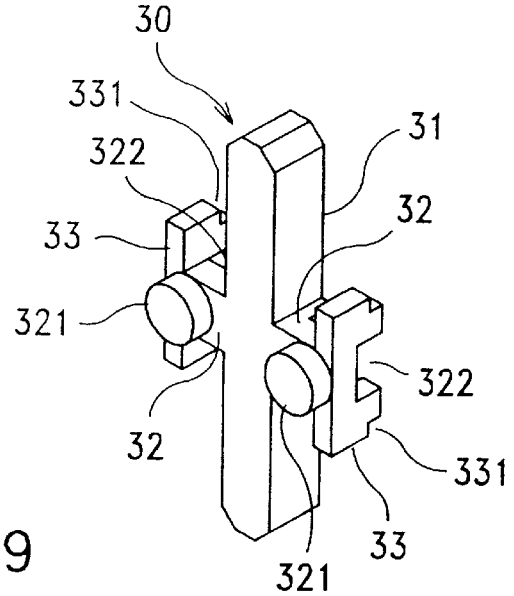
FIG. 9 is an elevational view of a fixed connector according to the present invention.
Figure 9A:
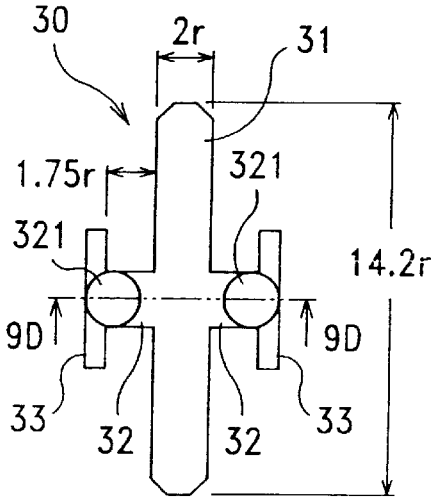
FIG. 9A is a front plain view of the fixed connector shown in FIG. 9.
Figure 9B:
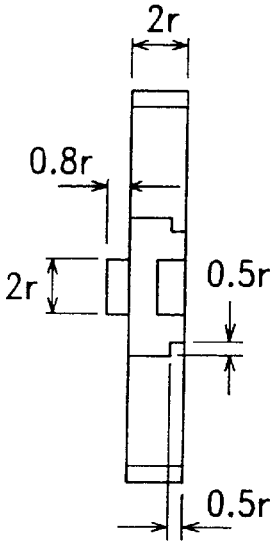
FIG. 9B is a right side view of the fixed connector shown in FIG. 9.
Figure 9C:
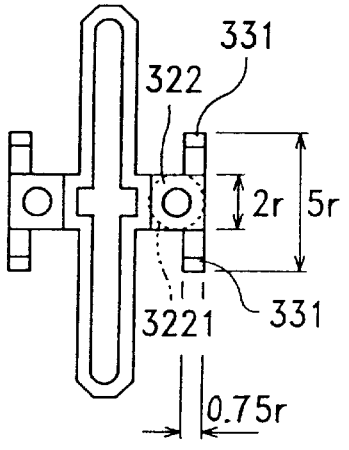
FIG. 9C is a back side view of the fixed connector shown in FIG. 9.
Figure 9D:
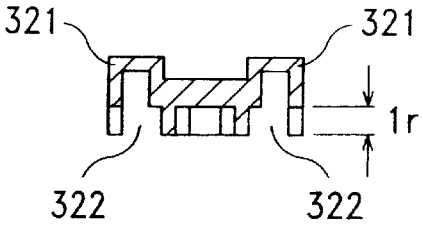
FIG. 9D is a sectional view taken along line 9D—9D of FIG. 9A.

Referring to FIG. 9, the fixed connector, referenced by 30, comprises a shaft 31, two projecting blocks 32 perpendicularly raised from two opposite sides of the shaft 31 in the middle, two pins 321 respectively and perpendicularly raised from the projecting blocks 32 at one side of which the size is equal to that of the pins 11 of the aforesaid block elements 10, two recessed holes 322 respectively formed in the projecting blocks 32 at an opposite side, two coupling blocks 33 respectively connected to the projecting blocks 32 at one end remote from and in parallel to the shaft 30. Each coupling block 33 fits the first retaining slots 14 of the aforesaid block elements 10, having two notches 331 fitting the steps 141 of one first retaining slot 14.

Referring to FIGS. from 9A to 9D, when the aforesaid unit length "r" is used for measuring the size of the fixed connector 30, the width of the shaft 31 is 2r, the length of the shaft 31 is 14.2r, the length of the projecting block 32 is 1.75r, the width of the projecting block 32 is 2r, the thickness of the projecting block 32 is 2r, the diameter of the pin 321 is 2r, the height of the pin 321 is 0.8r, the recessed hole 322 has a rectangular shape defining an inscribed circle of diameter 2r and depth 1r, the length of the coupling block 33 is 5r, the width of the coupling block 33 is 0.5r, the thickness of the coupling block 33 is 2r, the longitudinal length of the notch 331 is 0.5r, the transverse length of the notch 331 is 0.5r.

Figure 10:
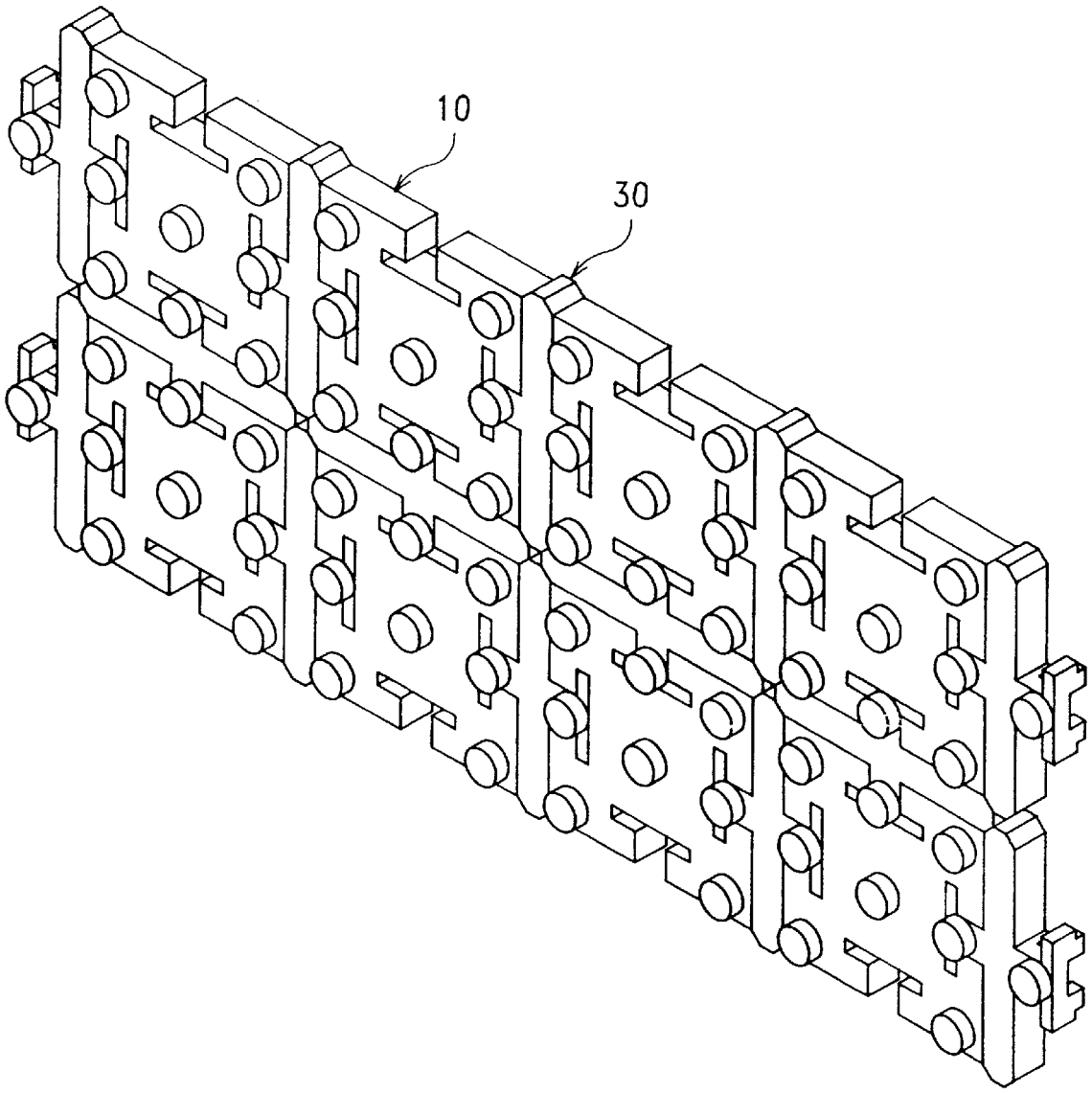
FIG. 10 shows a plurality of square block elements connected with one another on the same plane by fixed connectors according to the present invention.
Figure 11A:
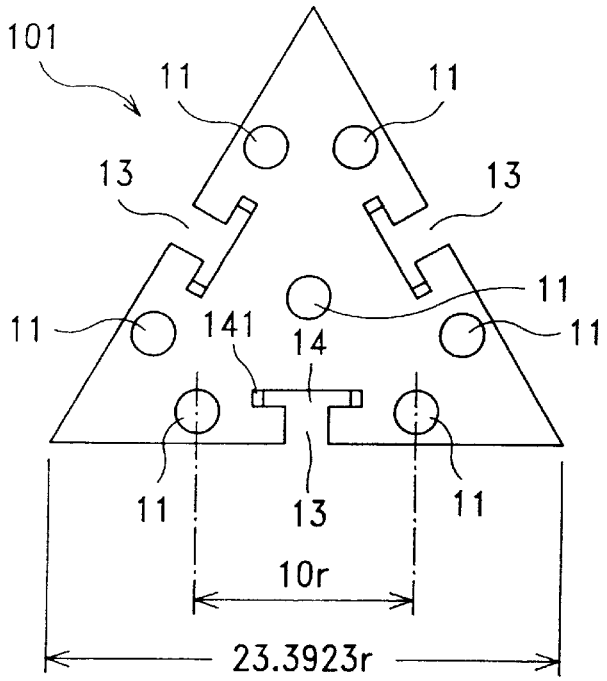
FIG. 11A is a front plain view of a triangular block element according to the present invention.
Figure 11B:
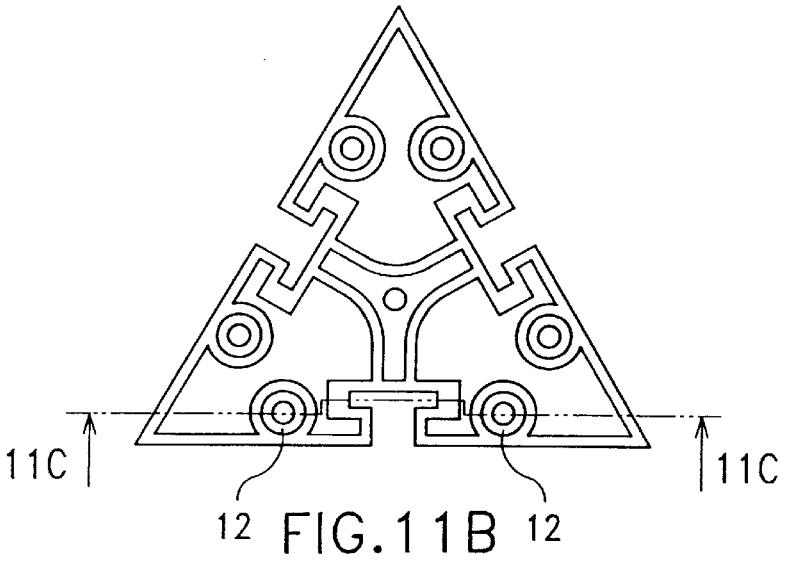
FIG. 11B is a back side view of the triangular block element shown in FIG. 11A.
Figure 11C:
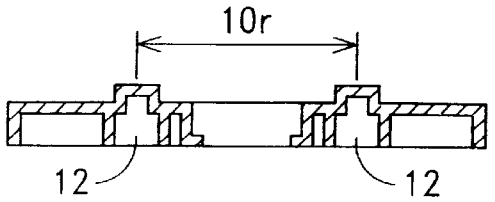
FIG. 11C is a sectional view taken along line 11C—11C of FIG. 11B.
Figure 12A:
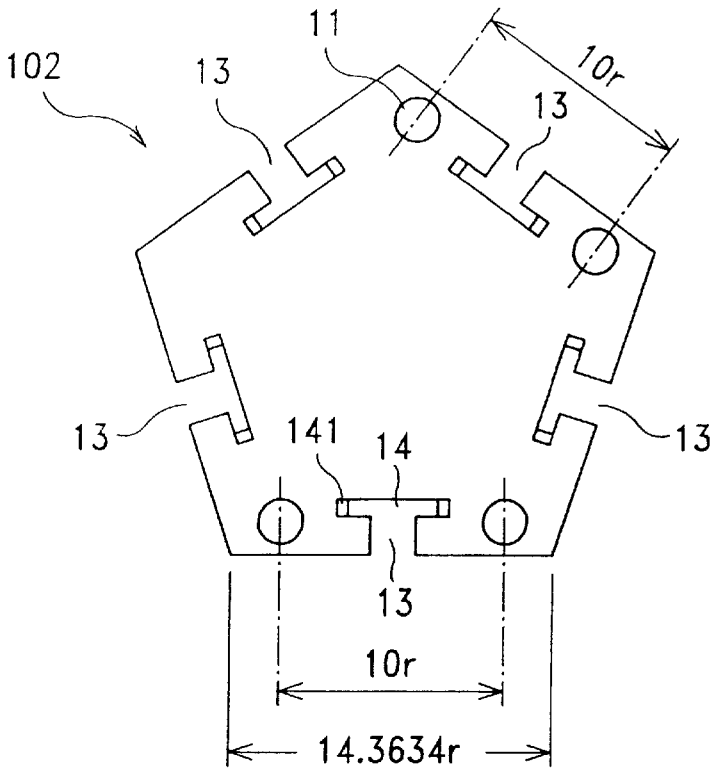
FIG. 12A is a front plain view of a pentagonal block element according to the present invention.
Figure 12B:
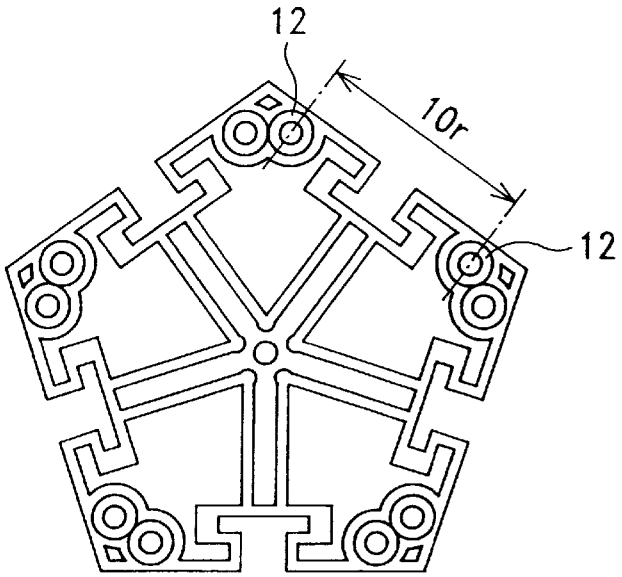
FIG. 12B is a back side view of the pentagonal block element shown in FIG. 12A.
Figure 13A:
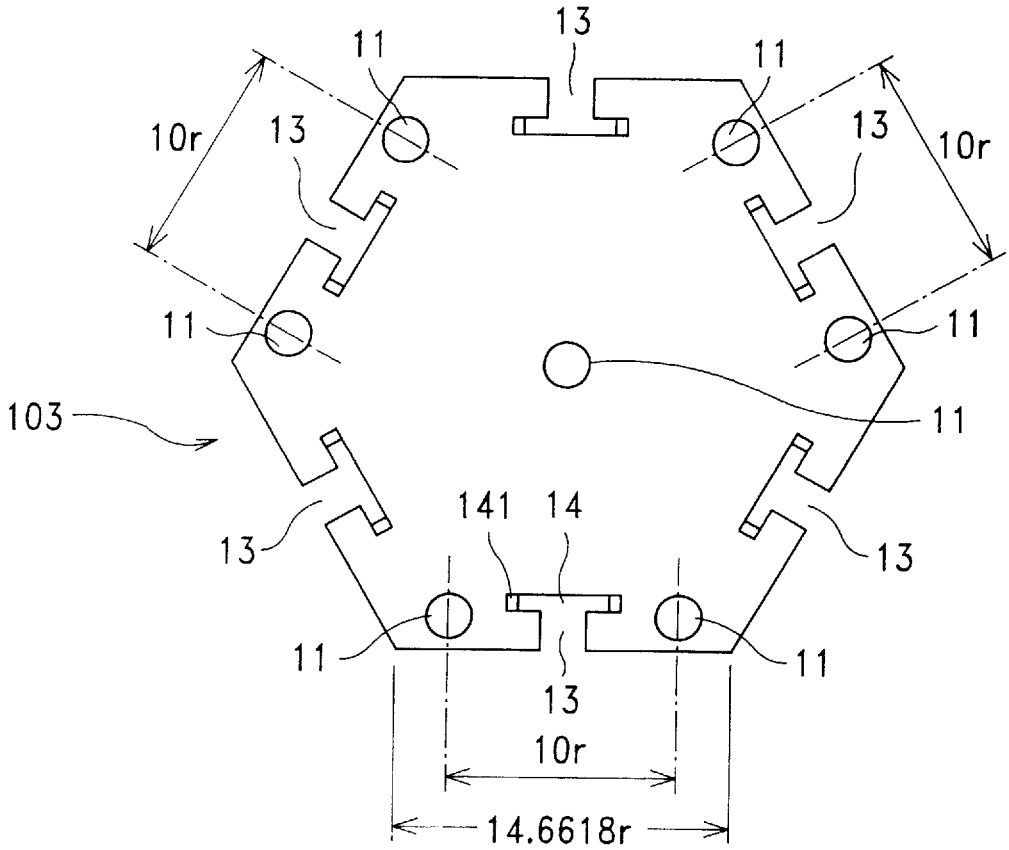
FIG. 13A is a front plain view of a hexagonal block element according to the present invention.
Figure 13B:
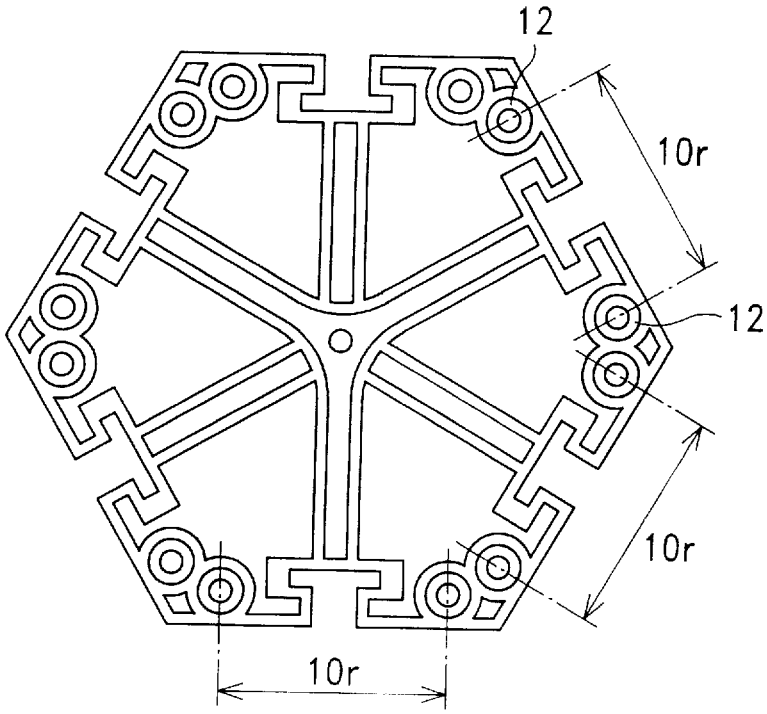
FIG. 13B is a back side view of the hexagonal block element shown in FIG. 13A.
Figure 14:
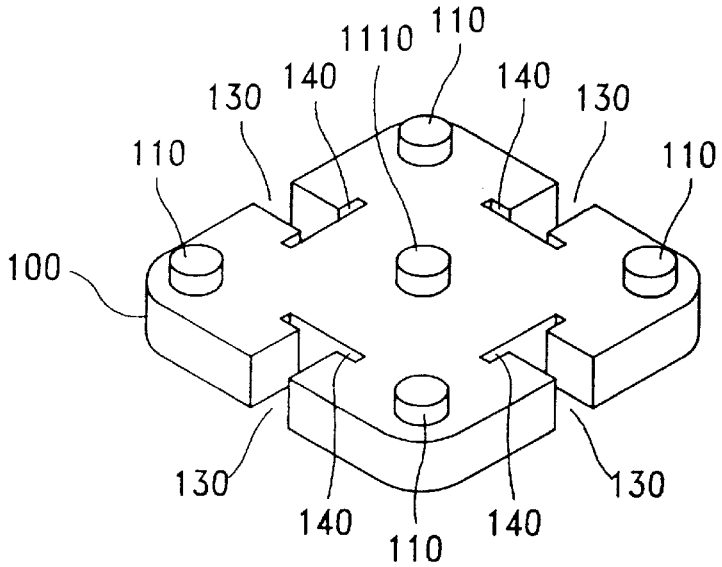
FIG.14 (PRIOR ART)
FIG. 14 shows the top side structure of a square block element according to U.S. Pat. No. 5,545,070.
Figure 15:
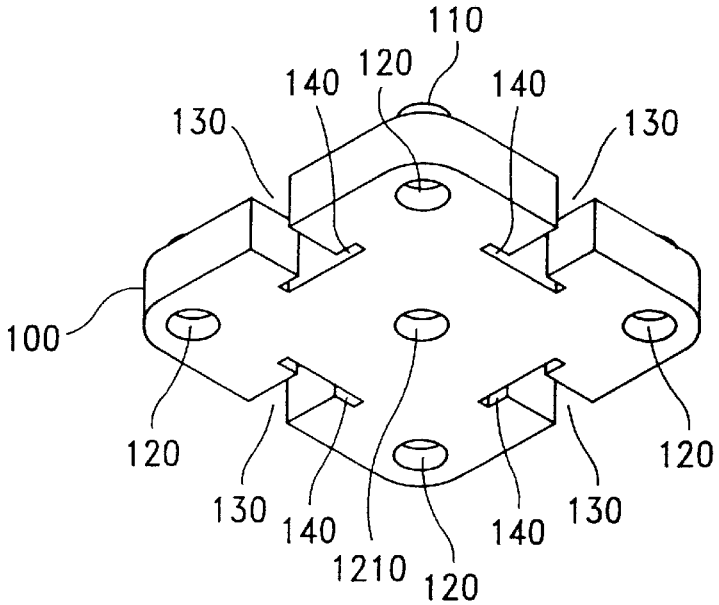
FIG.15 (PRIOR ART)
FIG. 15 shows the bottom side structure of the square block element shown in FIG. 14.
Figure 17:
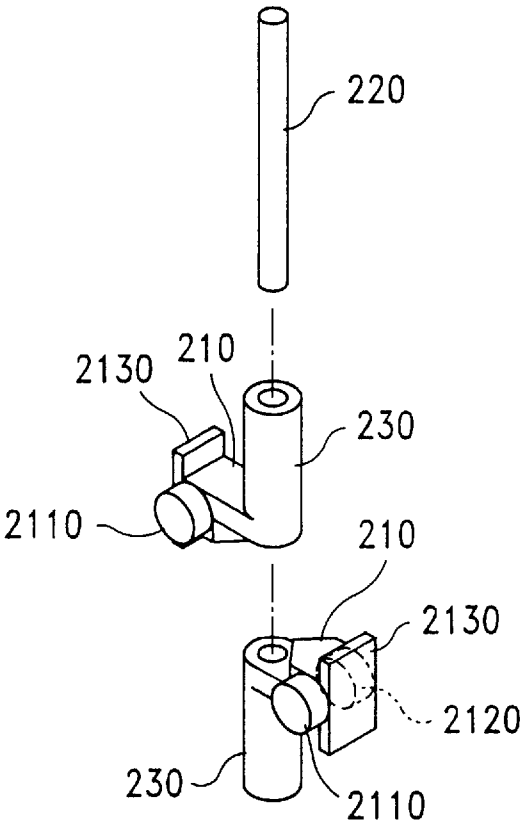
FIG.17 (PRIOR ART)
Figure 16:
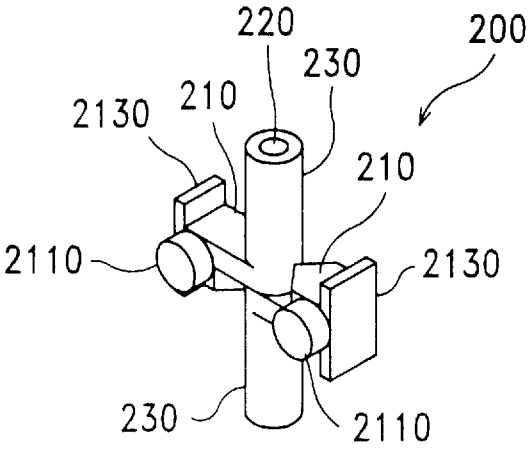
FIG.16 (PRIOR ART)
FIG. 16 is an elevational view of a swivel connector according to U.S. Pat. No. 5,545,070; and, FIG. 17 is an exploded view of the swivel connector shown in FIG. 16.

According to the aforesaid specifications, the pin 11 can be fitted into the recessed hole 322; the coupling recess 12 can be engaged with the pin 321 firmly; the second retaining hole 13 can be engaged with the projecting block 32, the first retaining hole 14 can be engaged with the coupling block 33. Because the fixed connector 30 is made in integrity, when a plurality of square block elements 10 are connected with one another on the same plane by respective fixed connectors 30, the constructed structure is firmly maintained in shape (see FIG. 10).

Referring to FIGS. from 11A to 11C, the block element, referenced by 101, is made of flat, regularly triangular shape having a plurality of pins 11 raised from the top side at the center and the three corners, a plurality of coupling recesses 12 at the bottom side corresponding to the pins 11, three elongated first retaining slots 14 equiangularly spaced around the center of the block element and respectively disposed in parallel with the three peripheral sides, and three second retaining slots 13 respectively and perpendicularly extended from the first retaining slots 14 to the border. The pins 11, except the one which is disposed at the center of the block element 101 are arranged into three pairs, each pair of pins being disposed at two opposite sides relative to one second retaining slot 13. Each first retaining slot 14 has two steps 141 symmetrically disposed near the two opposite ends. When the aforesaid unit length "r" is used for measuring the size of the block element 30, the length of the peripheral sides is 23.3823r, the distance between the two pins 11 at two opposite sides of each second retaining slot 13 is 10r.

Referring to FIGS. from 12A and 12B, the block element, referenced by 102, is made of flat, pentagonal shape having five elongated first retaining slots 14 equiangularly spaced around the center of the block element and respectively disposed in parallel with the five peripheral sides, five second retaining slots 13 respectively and perpendicularly extended from the first retaining slots 14 to the border, two pairs of pins 11 respectively raised from the top side adjacent to two separated peripheral sides at two opposite locations relative to the respective second retaining slot 13, and five pairs of coupling recesses 12 respectively disposed at the bottom side corresponding to the five peripheral sides. When measured by the aforesaid unit length "r" the distance between the two pins 11 of the same pair is 10r, the length of the peripheral sides is 14.3634r, the distance between the two coupling recesses 12 of the same pair is 10r.

Referring to FIGS. from 13A and 13B, the block element, referenced by 103, is made of flat, hexagonal shape having six elongated first retaining slots 14 equiangularly spaced around the center of the block element and respectively disposed in parallel with the six peripheral sides, six second retaining slots 13 respectively and perpendicularly extended from the first retaining slots 14 to the border, a plurality of pins 11 respectively raised from the top side at the center and the border area, and six pairs of coupling recesses 12 respectively disposed at the bottom side corresponding to the six peripheral sides. The pins 11, except that at the center of the block element 103, are arranged in pairs respectively disposed adjacent to three separated peripheral sides, and the two pins of the same pair are disposed at two opposite locations relative to one first retaining slot 13. When measured by the aforesaid unit length "r", the distance between the two pins 11 of the same pair is 10r, the length of the peripheral sides is 14.6618r, the distance between the two coupling recesses 12 of the same pair is 10r.

It is to be understood that the drawings are designed for purposes of illustration only, and are not intended as a definition of the limits and scope of the invention disclosed.

What the invention claimed is:

1. A construction toy block and connector set comprising a plurality of block elements (10, 101, 102, 103) for connection with one another, a plurality of swivel connectors (20) for connecting said block elements together for allowing them to be turned relative to one another, and a plurality of fixed connectors (30) for connecting said block elements (10, 101, 102, 103) together and holding them on a plane, said block elements (10, 101, 102, 103) each having a plurality of pins (11) at a top side thereof and a plurality of coupling recesses (12) at a bottom side thereof, a plurality of elongated first retaining slots (14) equiangularly spaced around a center of said respective block element and respectively disposed in parallel with a respective peripheral side of said respective block element and a plurality of second retaining slots (13) respectively and perpendicularly extended from said first retaining slots (14) to a border of said respective block element, characterized in that: each of said swivel connectors (20) comprises a base element (21), an auxiliary element (22), and an axle (23), said base element (21) comprising a barrel (216), a projecting block (211) perpendicularly raised from a periphery of said barrel (216) in the middle, a pin (212) perpendicularly raised from said projecting block (211) at one side of which the size is equal to that of the pins (11) of said block elements (10, 101, 102, 103), a recessed hole (213) formed in said projecting block (211) at an opposite side, a coupling block (214) connected to said projecting block (211) at one end remote from and in parallel to said barrel (216), and a transverse slot (215) across said barrel (216) in the middle corresponding to said projecting block (211), the coupling block (214) of said base element (21) fitting the first retaining slots (14) of said block elements (10, 101, 102, 103), said auxiliary element (22) comprising a substantially rectangular base (222), a pin (223) perpendicularly raised from one lateral side of said base (222) of which the size is equal to that of the pins (11) of said block elements (10, 101, 102, 103), a recessed hole (224) formed in an opposite lateral side of said base (211), a coupling eye plate (221) longitudinally raised from a front side of said base (222) and adapted for fitting into the transverse opening (215) of said base element (21), and a coupling block (225) perpendicularly connected to a rear side of said base (222), the coupling block (225) of said auxiliary element (22) fitting the first retaining slots (14) of said block elements (10, 101, 102, 103), said axle (23) being inserted into the barrel (216) of said base element (21) and the coupling eye plate (221) of said auxiliary element (22) to connect them together, permitting them to be respectively turned thereabout; each of said fixed connectors (30) comprises a shaft (31), two projecting blocks (32) perpendicularly raised from two opposite sides of said shaft (31) in the middle, two pins (321) respectively and perpendicularly raised from the projecting blocks (32) of the respective fixed connector at one side of which the size is equal to that of the pins (11) of the aforesaid block elements (10), two recessed holes (322) respectively formed in the projecting blocks (32)

of the respective fixed connector at an opposite side, two coupling blocks (33) respectively connected to the projecting blocks (32) of the respective fixed connector at one end remote from and in parallel to said shaft (31), each coupling block (33) of said fixed connectors (30) fitting the first retaining slots (14) of said block elements (10, 101, 102, 103), the pins (11) of said block elements (10, 101, 102, 103) fit the coupling recesses (12) thereof and the recessed holes (213) of the base elements (21) of said swivel connectors (20) and the recessed holes (224) of the auxiliary elements (22) of said swivel connector the coupling recesses (12) of said block elements fit the pins (212) of the base elements (21) of said swivel connectors (20) and the pins (223) of the auxiliary elements (22) of said swivel connectors (20), the first retaining holes (14) of said block element (10, 101, 102, 103) fit the coupling blocks (214) of the base elements (21) of said swivel connectors (20) and the coupling blocks (225) of the auxiliary elements (22) of said swivel connectors (20); the pins (11) of said block elements (10, 101, 102, 103) fit the recessed holes (322) of said fixed connectors (30); the coupling recesses (12) of said block elements (10, 101, 102, 103) fit the pins (321) of said fixed connectors; the second retaining holes (13) of said block elements (10, 101, 102, 103) fit the projecting blocks (32) of said fixed connectors (30); the first retaining slots (14) of said block elements (10, 101, 102, 103) fit the coupling blocks (33) of said fixed connectors (30).

2. The construction toy block and connector set of claim 1 wherein each of said first retaining slots (14) has two steps (141) symmetrically disposed at two opposite ends; the coupling block (214) of the base element (21) of each of said swivel connector (20) has two notches (2141) respectively fitting the steps (141) of each of said first retaining slots (14); the coupling block (225) the auxiliary element (22) of each of said swivel connector (20) has two notches (2251) respectively fitting the steps (141) of each of said first retaining slots (14); each of the coupling blocks (33) of each of said fixed connector (30) has two notches (331) respectively fitting the steps (141) of each of said first retaining slots (14).

3. The construction toy block set of claim 1 wherein said block elements (10, 101, 102, 103) include a plurality of triangular block elements (101), each of said triangular block elements (101) comprising three pairs of pins (11) raised from the top side corresponding to the three peripheral sides, a plurality of coupling recesses (12) at the bottom side corresponding to the pins (11), three elongated first retaining slots (14) equiangularly spaced around the center of the respective triangular block element and respectively disposed in parallel with the three peripheral sides of the respective triangular block element, and three second retaining slots (13) respectively and perpendicularly extended from the first retaining slots (14) to the border of the respective triangular block element, the distance between the two pins (11) of the same pair of each of said triangular block elements (101) being 10 length units and the peripheral sides of said triangular block elements (101) having a length of 23.3923 length units.

4. The construction toy block set of claim 3 wherein each of said triangular block elements (101) further comprises a pin (11) disposed at a center of the top side.

5. The construction toy block set of claim 1 wherein said block elements (10), 101, 102, 103) include a plurality of flat square block elements (10), each of said square block elements (10) comprising four pins (11) respectively raised from the top side at the four corners, the distance between each two adjacent pins (11) of said square block elements (10) being 10 length units, and the peripheral sides of said square block elements (10) having a length of 13 length units.

6. The construction toy block set of claim 5 wherein each of said square block elements (10) further comprises a pin (11) disposed at a center of the top side.

7. The construction toy block set of claim 1 wherein said block elements (10, 101, 102, 103) include a plurality of flat, pentagonal block elements (102), each of said pentagonal block elements (102) comprising five elongated first retaining slots (14) equiangularly spaced around a center of the block element and respectively disposed in parallel with the five peripheral sides thereof, five second retaining slots (13) respectively and perpendicularly extended from the first retaining slots (14) to the border of the block element, two pairs of pins (11) respectively raised from the top side adjacent to two separated peripheral sides at two opposite locations relative to the respective second retaining slot (13), and five pairs of coupling recesses (12) respectively disposed at the bottom side corresponding to the five peripheral sides.

8. The construction toy block set of claim 7 wherein the length of the peripheral sides of each of said pentagonal block elements (102) is 14.3634 length units, and the distance between each two pins (11) of the same pair of said pentagonal block elements (102) is 10 length units.

9. The construction toy block set of claim 1 wherein said block elements (10, 101, 102, 103) include a plurality of flat, hexagonal block elements (103), each of said hexagonal block elements (103) comprising six elongated first retaining slots (14) equiangularly spaced around a center of the block element and respectively disposed in parallel with the six peripheral sides thereof, six second retaining slots (13) respectively and perpendicularly extended from the first retaining slots (14) to the border of the block element, six pairs of coupling recesses (12) respectively disposed at the bottom side corresponding to the six peripheral sides, and a plurality of pins (11) being arranged in pairs respectively raised from the top side adjacent to three separated peripheral sides of the block element, and the two pins of the same pair being disposed at two opposite locations relative to one first retaining slot of the block element.

10. The construction toy block set of claim 9 wherein the length of the peripheral sides of each of said hexagonal block elements (103) is 14.6618 length units, and the distance between the two pins 11 of the same pair of said hexagonal block elements (103) is 10 length units.

11. The construction toy block set of claim 1 wherein the length of said barrel (216) of said base element (21) of said swivel connectors (20) is 14.2 length units, and the diameter thereof is 2 length units.

12. The construction toy block set of claim 1 wherein the length of the shaft (31) of each of said fixed connectors (30) is 14.2 length units, and the diameter thereof is 2 length units.

* * * * *